US005187003A

United States Patent [19]

Chitrangad

[11] Patent Number: 5,187,003

[45] Date of Patent: Feb. 16, 1993

[54] HYBRID BALLISTIC FABRIC

[75] Inventor: Chitrangad, Midlothian, Va.

[73] Assignee: E. I. du Pont de Nemours and Company, Wilmington, Del.

[21] Appl. No.: 798,606

[22] Filed: Nov. 26, 1991

[51] Int. Cl.[5] ..... D03D 15/00

[52] U.S. Cl. ..... 428/225; 139/420 A; 139/420 R; 428/229; 428/257; 428/258; 428/259; 428/911; 428/902

[58] Field of Search ..... 428/229, 225, 257, 258, 428/259, 911, 902; 139/420 R, 420 A

[56] References Cited

FOREIGN PATENT DOCUMENTS 1034842 7/1978 Canada .
310199 4/1989 European Pat. Off. .
9529789 4/1989 Japan .

*Primary Examiner*—James J. Bell

[57] ABSTRACT

A woven fabric for ballistic protection is disclosed wherein the fibers in the fill direction exhibit an elongation to break greater than the elongation to break of the fibers in the warp direction.

12 Claims, No Drawings

HYBRID BALLISTIC FABRIC

BACKGROUND OF THE INVENTION

1. Field of the Invention

This invention relates to a fabric especially useful for ballistic protection wherein the fill fibers in the fabric are chosen to be tougher and to have higher elongation to break than the warp fibers in the fabric.

2. Description of the Prior Art

Canadian Pat. No. 1,034,842, issued Jul. 18, 1978 on the application of Weinberger, discloses a fabric useful for ballistics protection which has dissimilar fibers in the warp and weft directions. The apparent reason for the dissimilar fibers in that patent, however, was to achieve dissimilar patterns of corrugation on opposite fabric surfaces. The fibers are desired to be "spongy" in the weft and "relatively hard" in the warp, with no further indication as to the meaning of "spongy" and "relatively hard". It appears that the improvement in the fabric resides in the different corrugations on opposite sides of the fabric.

European patent application 310,199, published Apr. 5, 1989 on the application of Hoogenboom et al., discloses a ballistic fabric wherein the warp and fill yarns are made from different polymers and, moreover, the warp yarn is selected to exhibit a higher elongation to break than the fill yarn.

SUMMARY OF THE INVENTION

The present invention provides a woven fabric of balanced ballistics properties comprising a warp of fibers with elongation to break greater than about 2.2% and as much as about 6.0% or perhaps slightly more; and a fill of fibers with elongation to break greater than that of the warp fibers.

DETAILED DESCRIPTION OF THE INVENTION

High tenacity fibers have long been used in weaving fabrics which exhibit good ballistics performance. Of course, there is a constant search for improvements in such fabrics; and this invention relates to such improvements. The fabrics of this invention exhibit ballistics performance which is improved over the ballistics performance of similar fabrics known before this invention.

For the purpose of understanding this invention, "warp" means the yarns in a woven fabric that run lengthwise and parallel with the selvage and are interwoven with the fill yarns.

By "fill" is meant the yarns in a woven fabric that run widthwise and from selvage to selvage and are interwoven with the warp yarns.

It has been the belief that fibers which exhibit a high elongation to break exhibit improved ballistics protection performance for a given tenacity. In the present invention, in addition, it has been discovered that ballistics performance of a woven fabric can be improved by using fibers having a higher elongation to break in the fill (transverse) direction than in the warp (machine) direction.

While understanding of the theory of operation of this invention is not complete and, indeed, is not necessary, it is believed that the dynamic deformation which occurs in a fabric during a ballistic event is generally asymmetric because, during the weaving process for the fabric, the fill yarns are incorporated into the fabric with more tension than the warp yarns. In other words, the fill yarns bend less than the warp yarns in the fabric construction and, therefore, in the course of a ballistics event, the fill yarns are stretched to break before the warp yarns. This problem is particularly relevant in the use of yarns exhibiting relatively low elongation to break of about 6.0% or less. By using a fabric with fill yarns having an elongation to break which is higher than the elongation to break for the warp yarns, the above-described problem is mitigated.

While the fabric of this invention is preferably made using yarns of para-aramid and copolymers of para-aramid, particularly of poly(p-phenylene terephthalamide), yarns of other materials generally used in ballistic fabrics can also be used herein. High tenacity, high modulus, low elongation fibers of high molecular weight polyolefins such as gel-spun polyethylene; or highly-oriented nylon or poly(vinyl alcohol); or the like can be used.

Yarns for use in this invention should be 55–3000 denier; and should have a tenacity, before weaving, of at least 18 gpd and a modulus of at least 350 gpd; and, after weaving, of at least 12 gpd, a modulus of at least 200 gpd, and an elongation to break of at least 2.2%. "gpd" means grams per denier. While these characteristics are appropriate for general identification of fibers eligible for use in the present invention, it is understood that the elongation to break for the fill fibers must be greater than the elongation to break for the warp fibers. It is preferred that the elongation to break for the fill fibers should be at least 110% of the elongation to break for the warp fibers.

While the effectiveness of a particular yarn is a function of both, tenacity and elongation to break, fabrics of this invention can be made using warp and fill yarns of different materials so long as the strengths of the yarns under ballistic breaking conditions are within a few grams per denier of each other and the elongation to break of the fill yarn is greater than that of the warp yarn.

The fabrics of this invention can be made using any weave customarily used for ballistics applications. The weave patterns most often used are plain weave and basket weave; but other weave patterns and variations on those patterns are certainly eligible. Specific examples of such variations include so-called crowfoot weaves, satin weaves, and twill weaves. "Cover factor" is a name given to the density of the weave of a fabric. Cover factor is a calculated value relating to the geometry of the weave and indicating the percentage of the gross surface area of a fabric which is covered by yarns of the fabric. The equation used to calculate cover factor is as follows (from Weaving: Conversion of Yarns to Fabric, Lord and Mohamed, published by Merrow (1982), pages 141–143):

$d_w$ = width of warp yarn in the fabric $d_f$ = width of fill yarn in the fabric $p_w$ = pitch of warp yarns (ends per unit length)

$p_f$ = pitch of fill yarns $$C_w = \frac{d_w}{p_w} \quad C_f = \frac{d_f}{p_f}$$

$$\text{Fabric Cover Factor} = C_{fab} = \frac{\text{total area obscured}}{\text{area enclosed}}$$

-continued $$C_{fab} = \frac{(p_w - d_w)d_f + d_w p_f}{p_w p_f} = (C_f + C_w - C_f C_w)$$

The fabric of this invention should have a cover factor of 0.6 to 0.95. Fabric with a cover factor of less than 0.6 would be too loose for effective ballistic protection and the yarns in a fabric having a cover factor of greater than 0.95 have likely been weakened by the rigors of the weaving process.

Test Methods

Denier. The denier of a yarn is determined by weighing a known length of the yarn. Denier is defined as the weight, in grams, of 9000 meters of the yarn.

In actual practice, the measured denier of a yarn sample, test conditions and sample identification are fed into a computer before the start of a test; the computer records the load-elongation curve of the yarn as it is broken and then calculates the properties.

Tensile Properties. Yarns tested for tensile properties are, first, conditioned and, then, twisted to a twist multiplier of 1.1. The twist multiplier (TM) of a yarn is defined as:

$$TM = (\text{twists/inch})/(5315/\text{denier of yarn})^{-\frac{1}{2}}$$

The yarns to be tested are conditioned at 25° C., 55% relative humidity for a minimum of 14 hours and the tensile tests are conducted at those conditions. Tenacity (breaking tenacity), elongation (breaking elongation), and modulus are determined by breaking test yarns on an Instron tester (Instron Engineering Corp., Canton, Mass.).

Tenacity, elongation, and initial modulus, as defined in ASTM D2101-1985, are determined using yarn gage lengths of 25.4 cm and an elongation rate of 50% strain/minute. The modulus is calculated from the slope of the stress-strain curve at 1% strain and is equal to the stress in grams at 1% strain (absolute) times 100, divided by the test yarn denier.

Ballistics Performance. Ballistics tests of multiply panels are conducted in accordance with MIL-STD-662D as follows: A layup to be tested is placed in a sample mount to hold the layup rigid and perpendicular to the path of test projectiles. The projectiles are 17-grain fragment simulating projectiles (MIL-P-46593) and are propelled from a test weapon capable of firing the projectiles at different velocities. The first firing for each layup is for a projectile velocity estimated to be the likely ballistics limit ($V_{50}$). When the first firing yields a complete layup penetration, the next firing is for a projectile velocity of about 50 feet per second less in order to obtain a partial penetration of the layup. On the other hand, when the first firing yields no penetration or partial penetration, the next firing is for a velocity of about 50 feet per second more in order to obtain a complete penetration. After obtaining one partial and one complete projectile penetration, subsequent velocity increases or decreases of about 50 feet per second are used until enough firings are made to determine the ballistics limit ($V_{50}$) for that panel.

The ballistics limit ($V_{50}$) is calculated by finding the arithmetic mean of an equal number of at least three of the highest partial penetration impact velocities and the lowest complete penetration impact velocities, provided that there is a difference of not more than 125 feet per second between the highest and lowest individual impact velocities.

DESCRIPTION OF THE PREFERRED EMBODIMENTS

In the following examples, fabrics were woven using several types of yarns made from poly(p-phenylene terephthalamide) (PPD-T). The fabrics included basket and plain weaves in a variety of weave densities.

EXAMPLE 1

A plain weave fabric was made having 24 yarn ends per inch in both the warp and the fill directions. The yarn in the warp direction was designated to be A Yarn and the yarn in the fill direction was designated to be B Yarn. Both yarns had a denier of 1500.

The A Yarn was that (PPD-T) aramid yarn product sold by E. I. du Pont de Nemours and Company under the designation "Kevlar K-29" having a yarn denier of 1500 and exhibiting Yarn Qualities of tenacity, elongation to break, and modulus (TEM) of 23.0 gpd, 3.6%, and 565 gpd, respectively.

The B Yarn was that PPD-T aramid yarn product sold by E. I. du Pont de Nemours and Company under the designation "Kevlar K-119" having a yarn denier of 1500 and exhibiting Yarn Qualities of tenacity, elongation to break, and modulus (TEM) of 24.4 gpd, 4.4%, and 448 gpd, respectively.

The fabric of this example used the yarn with higher elongation in the fill direction. Two control fabrics were made—one made wholly from A Yarn and another made wholly from B Yarn. Ballistic performance tests were conducted on panels made using six plies of the fabric at a total areal density of 0.46 pounds per square foot. Results are shown in the Table. All of the fabrics had a cover factor of 0.75.

TABLE

| | Ballistics Performance | |
|---|---|---|
| Example | $V_{50}$+ (ft/sec) | $V_{50}$ Change (%) |
| 1 (A and B) | 1304 | 3% against A Yarn control<br>5.6% against B Yarn control |
| A Yarn Control | 1266 | |
| B Yarn Control | 1235 | |

EXAMPLE 2

For this example, a basket weave fabric was made having 35 yarn ends per inch in the warp direction and 34 yarn ends per inch in the fill direction. The yarn in the warp direction was the A Yarn of the previous example and the yarn in the fill direction was the B Yarn of the previous example.

One control fabric was made wholly from the A Yarn. Ballistic performance tests were conducted on panels made using 12 plies of the fabric at a total areal density of 1.2 pounds per square foot. Results are shown in the Table. All of the fabrics had a cover factor of 0.89.

TABLE

| | Ballistics Performance | |
|---|---|---|
| Example | $V_{50}$+ (ft/sec) | $V_{50}$ Change (%) |
| 2 (A and B) | 1761 | 7% against the Control |
| A Yarn Control | 1645 | |

EXAMPLE 3

In this example, a plain weave fabric was made having 64 yarn ends per inch in both the warp and the fill directions. The yarn in the warp direction was designated to be C Yarn and the yarn in the fill direction was A Yarn, as identified in the previous examples except that it had a denier of only 200.

The C Yarn was that poly (p-phenylene terephthalamide) aramid yarn product sold by E. I. du Pont de Nemours and Company under the designation "Kevlar K-49" having a yarn denier of 200 and exhibiting Yarn Qualities of tenacity, elongation to break, and modulus (TEM) of 24.3 gpd, 2 2%, and 965 gpd, respectively. The A Yarn exhibited Yarn Qualities of Tenacity, elongation to break, and modulus (TEM) of 24.7 gpd, 2.93%, and 800 gpd, respectively.

The fabric of this example used the yarn with higher elongation in the fill direction. Ballistic performance tests were conducted on panels made using 26 plies of the fabric at a total areal density of 0.64 pounds per square foot. A control fabric was made wholly from A Yarn having a denier of 1000; and ballistic performance tests were conducted on panels of the control using 11 plies at a total areal density of 0.63 pounds per square foot. Results are shown in the Table. The cover factor for the fabric using 200 denier yarns was 0.70 and the cover factor for the fabric using 1000 denier yarns was 0.74.

TABLE

| | Ballistics Performance | |
|---|---|---|
| Example | $V_{50}$+ (ft/sec) | $V_{50}$ Change (%) |
| 3 (A and C) | 1528 | 4.7% against the Control |

TABLE-continued

| | Ballistics Performance | |
|---|---|---|
| Example | $V_{50}$+ (ft/sec) | $V_{50}$ Change (%) |
| A Yarn Control | 1460 | |

I claim:

1. A woven fabric for ballistic protection comprising a warp of fibers with elongation to break greater than 2.2% and a fill of fibers with elongation to break greater than that of the warp fibers.

2. The fabric of claim 1 wherein the warp of fibers has an elongation to break from 2.2% to 6.0%.

3. The fabric of claim 1 wherein the fibers of the warp and of the fill have a tenacity of greater than 12 gpd and a modulus of greater than 200 gpd.

4. The fabric of claim 2 wherein the fibers of the warp and of the fill have a tenacity of greater than 12 gpd and a modulus of greater than 200 gpd.

5. The fabric of claim 3 wherein the fibers of the warp and of the fill are aramid.

6. The fabric of claim 5 wherein the aramid is poly(p-phenylene terephthalamide).

7. The fabric of claim 4 wherein the fibers of the warp and of the fill are aramid.

8. The fabric of claim 7 wherein the aramid is poly(p-phenylene terephthalamide).

9. The fabric of claim 1 having a cover factor of 0.6 to 0.95.

10. The fabric of claim 2 having a cover factor of 0.6 to 0.95.

11. The fabric of claim 1 wherein the warp fibers and the fill fibers, before being woven into the fabric, have a tenacity of greater than 18 gpd and a modulus greater than 350 gpd.

12. The fabric of claim 2 wherein the warp fibers and the fill fibers, before being woven into the fabric, have a tenacity of greater than 18 gpd and a modulus greater than 350 gpd.

* * * * *